US006761536B1

(12) United States Patent
Bash et al.

(10) Patent No.: US 6,761,536 B1
(45) Date of Patent: Jul. 13, 2004

(54) TURBINE BLADE PLATFORM TRAILING EDGE UNDERCUT

(75) Inventors: Gary Bash, Jupiter, FL (US); J. Page Strohl, Tequesta, FL (US)

(73) Assignee: Power Systems Mfg, LLC, Jupiter, FL (US)

( * ) Notice: Subject to any disclaimer, the term of this patent is extended or adjusted under 35 U.S.C. 154(b) by 0 days.

(21) Appl. No.: 10/355,883

(22) Filed: Jan. 31, 2003

(51) Int. Cl.[7] ..... F01D 5/18
(52) U.S. Cl. ..... 416/193 A; 416/209.4
(58) Field of Search ..... 416/193 A, 193 R, 416/189–191, 209.4, 248, 500; 415/77–79

(56) References Cited

U.S. PATENT DOCUMENTS 5,244,345 A * 9/1993 Curtis ..... 416/95
5,827,047 A * 10/1998 Gonsor et al. ..... 416/193 A
5,947,687 A 9/1999 Mori et al.
5,988,980 A * 11/1999 Busbey et al. ..... 416/193 R
6,390,775 B1 5/2002 Paz
6,481,967 B2 * 11/2002 Tomita et al. ..... 416/97 R

* cited by examiner

*Primary Examiner*—Edward K. Look
*Assistant Examiner*—J. M. McAleenan
(74) *Attorney, Agent, or Firm*—Brian R. Mack

(57) ABSTRACT

A gas turbine blade having an airfoil to platform interface configured to minimize thermal and vibratory stresses is disclosed. This configuration minimizes exposure to the conditions that are known to cause high cycle fatigue and low cycle fatigue cracks. The turbine blade incorporates a channel in the platform trailing edge that extends from the platform concave face to the platform convex face and has a portion having a constant radius. The channel extends a sufficient distance into a stress field created by the aerodynamic loading of the turbine blade airfoil in order to redirect the mechanical stresses away from the blade trailing edge while allowing the platform trailing edge region to be more responsive to thermal fluctuations.

4 Claims, 4 Drawing Sheets

FIG. 6

TURBINE BLADE PLATFORM TRAILING EDGE UNDERCUT

BACKGROUND OF THE INVENTION

1. Field of the Invention

The present invention relates to a gas turbine blade rotating airfoil and more specifically to a means for relieving stress proximate the blade platform trailing edge.

2. Description of Related Art

In a gas turbine engine, turbine blades are exposed to severe operating conditions and as a result, the blades are susceptible to high cycle fatigue (HCF), low cycle fatigue (LCF), and thermal mechanical fatigue (TMF) cracking in the region where the airfoil meets the blade platform. In order to minimize the exposure of this region to HCF, LCF, or TMF cracking, it is important to isolate this region from the main load path of the airfoil. The cycling can be driven by either temperature or resonance.

As hot combustion gases pass through the turbine section of the engine, blade temperatures can rise well above the operating level of the blade material. In order to compensate for this temperature effect, turbine blades are cooled. Typical cooling configurations have a cooling medium entering the blade through an attachment region and traveling radially outward through the platform to the airfoil. Once in the airfoil, the cooling medium may make several radial passes through the airfoil before exiting through a plurality of holes in either the airfoil surface, blade tip, or blade trailing edge. In order to maximize the amount of gases passing through the turbine and the overall blade weight, the airfoil sections are relatively thin. In contrast, blade platform sections are much thicker and have a higher mass in order to provide adequate support for the airfoil and its associated loads. Therefore, given exposure to a generally uniform combustion gas temperature, the platform region, having a greater mass, is less responsive to thermal changes than the airfoil, creating effectively a thermal fight at their interface, resulting in high thermal stresses.

Normal engine operations can result in cycling of these high thermal stresses, which can lead to crack initiation and potentially damaging crack propagation.

The other principal driver in HCF crack propagation in the region where the airfoil meets the platform is resonance. That is, the airfoil experiences a vibration due to the surrounding turbine and combustion environment. More specifically, this could be due to low order frequency modes, the effects of the quantity of upstream or downstream blades and vanes, or effects from the combustion system.

Manufacturers of prior art turbine blades have attempted to address the thermal stress issues by providing a cutback to the platform, to allow the platform to respond for actively to temperature fluctuations. Two examples of prior art blades contain this cutback, 15 and 46, shown in FIGS. 1 and 2, respectively. The prior art blade in FIG. 1 attempts to address crack propagation by incorporating a cutback along the trailing edge side of the platform. However, this cutback does not extend into the stress field created by the turbine blade airfoil, and therefore cannot redirect the mechanical stresses away from the blade trailing edge while allowing the platform trailing edge region to be more responsive to thermal fluctuations. The prior art blade shown in FIG. 2 also attempts to address the concern of crack propagation by directing the load path of airfoil 40 away from the trailing edge side 48. This is accomplished by configuring cutback

46 such that it is oriented at an angle with respect to the mean camber line of airfoil 40, with cutback 46 beginning on the concave side of the platform and exiting the platform on the trailing edge side. Furthermore, cutback 46 extends to a depth that enters the load path of airfoil 40 to further reduce the vibratory effects of airfoil 40 at the trailing edge region. The preferred embodiment for incorporating this cutback configuration, given its complex geometry, while maintaining structural integrity of the airfoil/platform region during the casting process, would be to machine the cutback into the platform region during blade final machining. However, this machining step requires additional time and machine set-up, and is more costly than if a cutback having a similar effect could be incorporated into the casting or into an existing machining step, where no additional cost is incurred.

Attempting to incorporate this type of cutback into a casting could result in casting flaws and excessive scrap parts since the cutback is only along a portion of the platform, thereby creating a non-uniform section of the blade platform to cool after the blade has been cast.

What is needed is a gas turbine blade having reduced vibratory and thermal stresses at the region between the airfoil trailing edge and adjacent platform, wherein the means for obtaining these reduced stress levels ease blade manufacturing.

SUMMARY AND OBJECTS OF THE INVENTION

In order to solve the problems presented by the prior art, the present invention discloses a turbine blade that has an airfoil to platform interface that is configured to minimize the thermal and vibratory stresses. Therefore, exposure to the conditions that are known to cause high cycle fatigue and low cycle fatigue cracks are minimized. This is accomplished by incorporating a channel in the platform trailing edge that extends from the platform concave face to the platform convex face. Extending the channel across the entire width of the platform removes unnecessary material from the blade platform, which lowers overall blade pull on the turbine disk, resulting in increased life of the blade attachment region. This channel can be incorporated into the turbine blade through either the casting or machining process. The channel, which has a portion having a constant radius, crosses into a line of stress created by the turbine blade airfoil load and redirects the mechanical stresses away from the blade trailing edge while allowing the platform trailing edge region to be more responsive to thermal fluctuations.

It is an object of the present invention is to provide a gas turbine blade with lower thermal and vibratory stresses.

It is another object of the present invention to incorporate a means for lowering the thermal and vibratory stresses while reducing manufacturing complexity.

It is yet another object of the present invention to reduce overall turbine blade weight while increasing blade attachment life.

In accordance with these and other objects, which will become apparent hereinafter, the instant invention will now be described with particular reference to the accompanying drawings.

DETAILED DESCRIPTION OF THE PREFERRED EMBODIMENT

Figure 2:
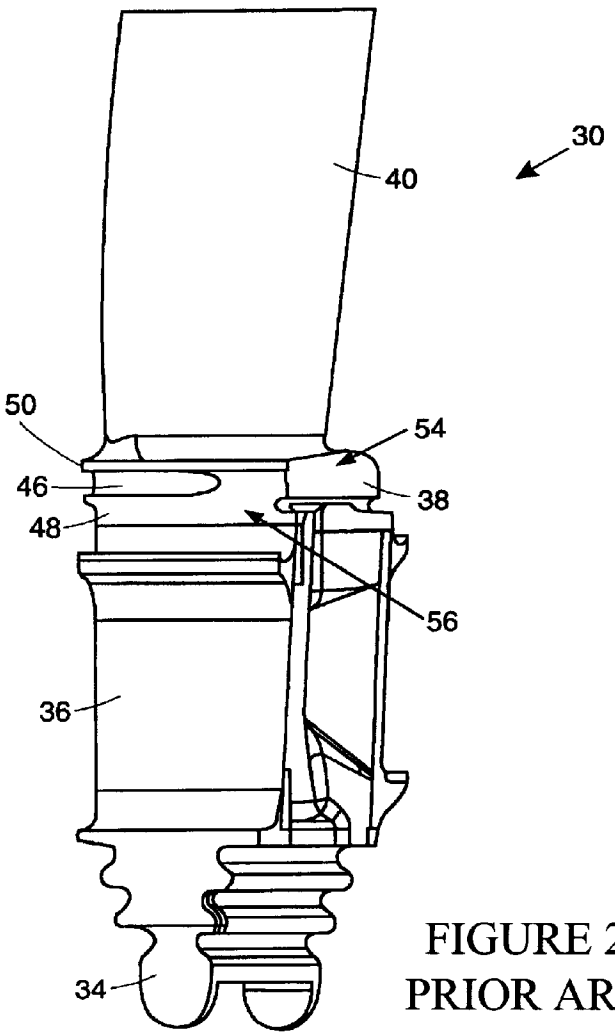
FIGURE 2 PRIOR ART
FIG. 2 is a perspective view of a second prior art turbine blade.
Figure 1:
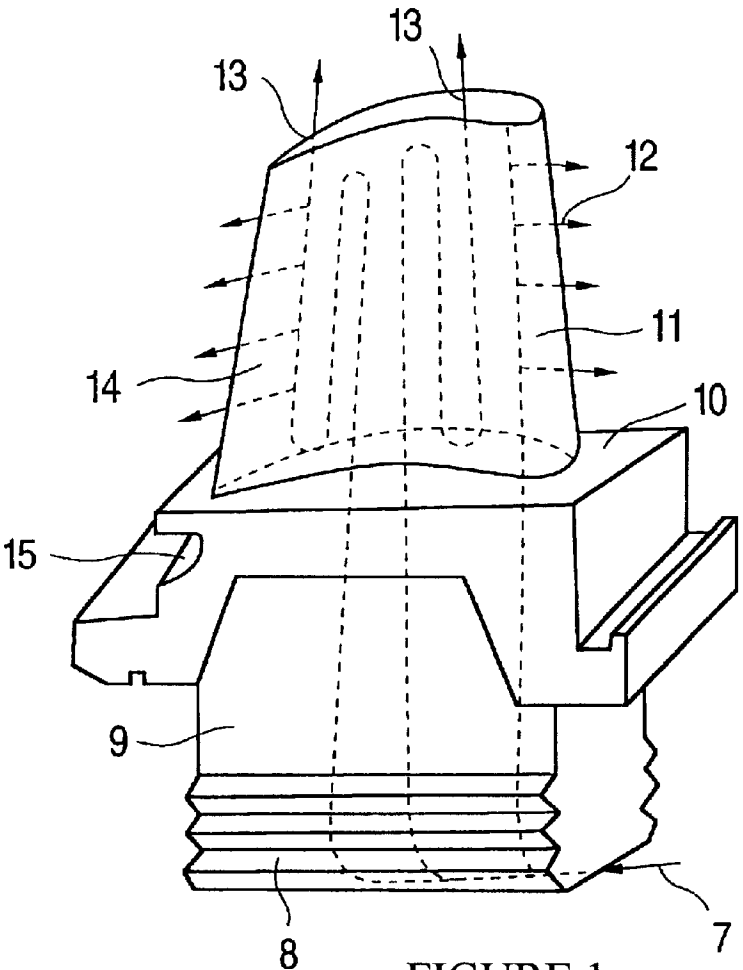
FIGURE 1 PRIOR ART
FIG. 1 is a perspective view of a first prior art turbine blade.
Figure 3:
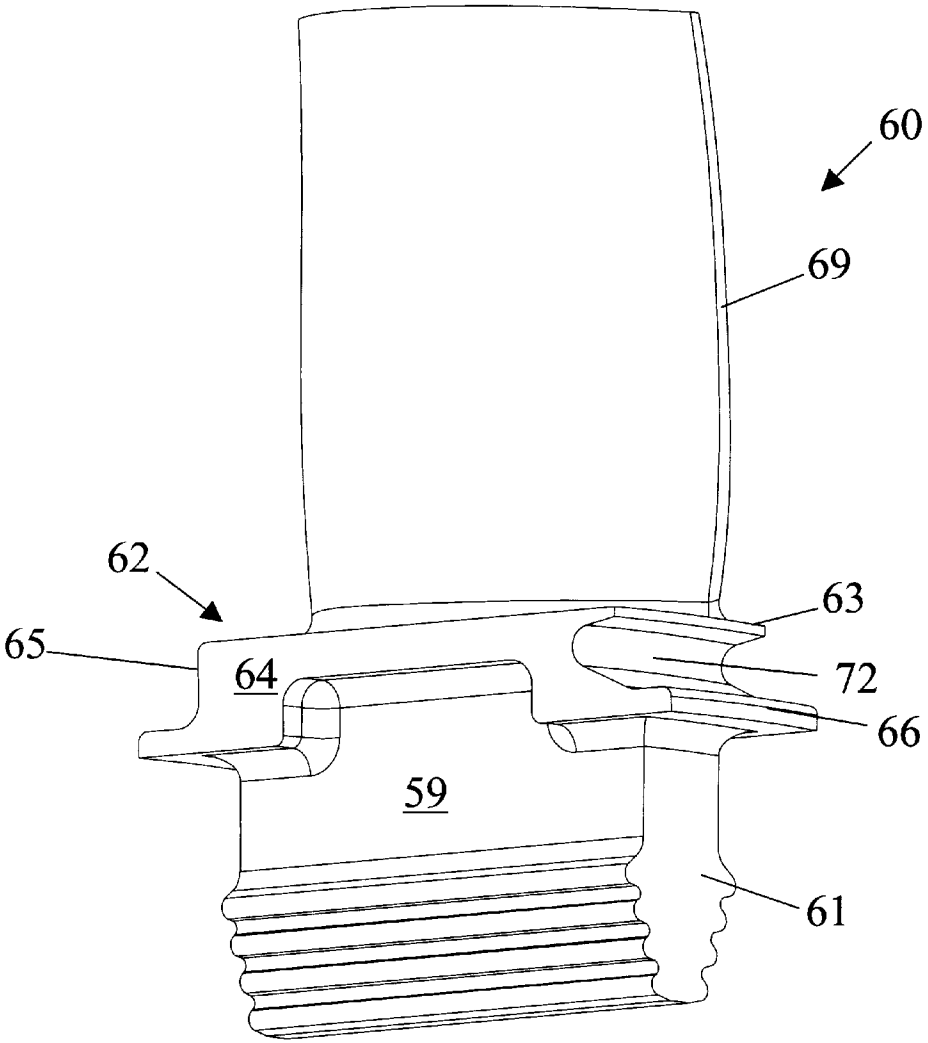
FIG. 3 is a perspective view of a turbine blade in accordance with the present invention.
Figure 5:
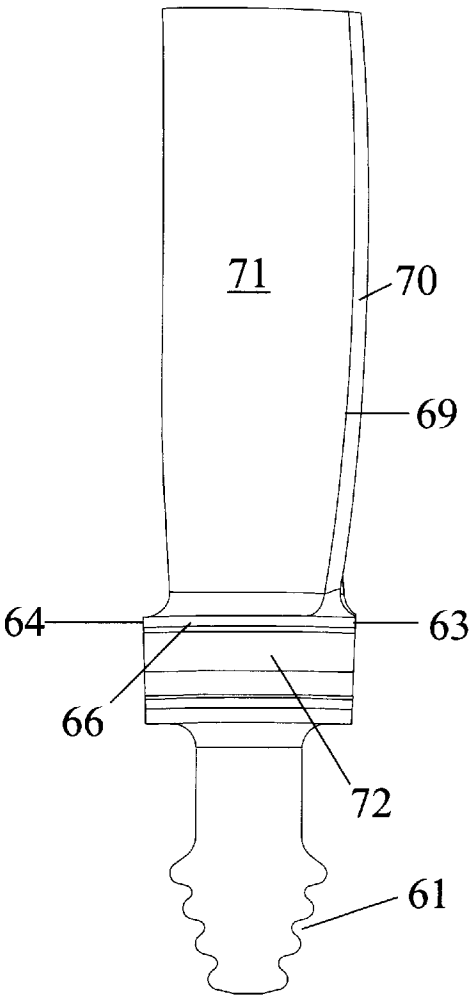
FIG. 5 is an end view of the trailing edge of a turbine blade in accordance with the present invention.
Figure 4:
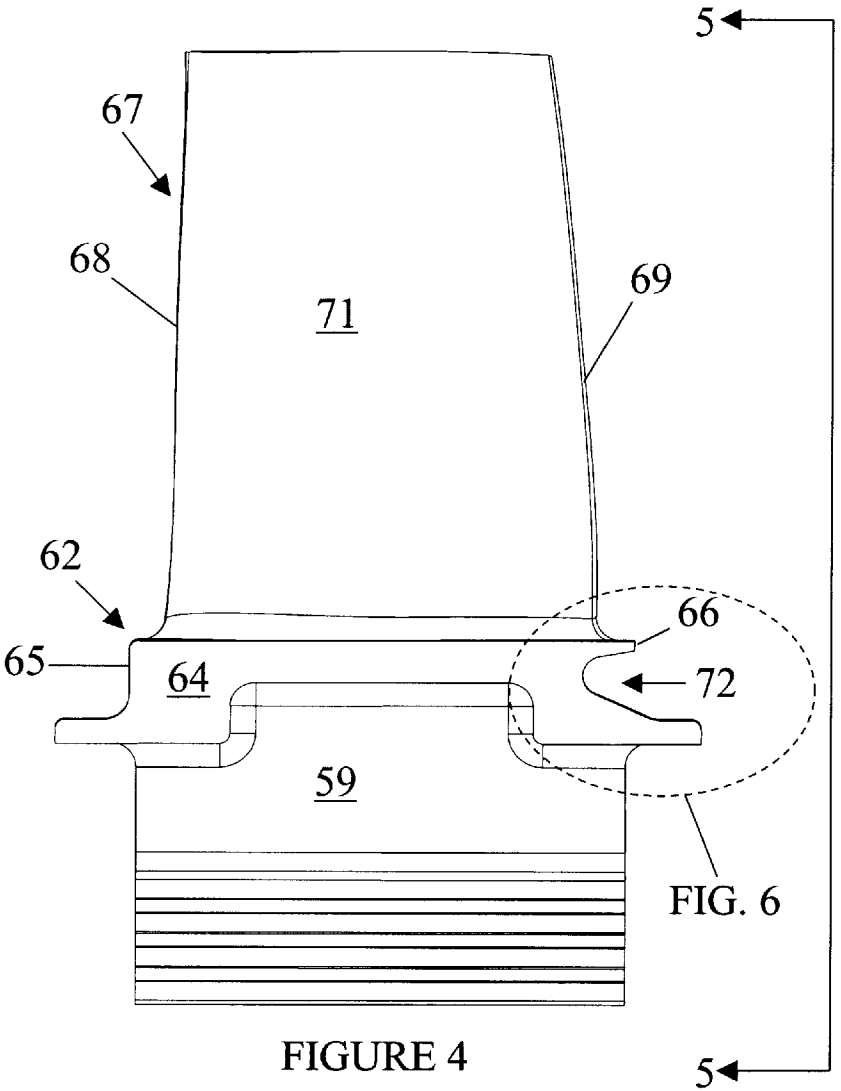
FIG. 4 is a side view of a turbine blade in accordance with the present invention.

The present invention will now be described in detail with reference made to the accompanying FIGS. 3–6. Referring now to FIG. 3, a preferred embodiment of the present invention is shown in perspective view. A gas turbine blade 60 has an attachment section 61 for fixing turbine blade 60 to a blade disk, which contains the turbine blades when rotating in a gas turbine engine. Referring to FIGS. 3–5 and extending radially outward from attachment 61 is a blade shank 59. Extending radially outward from blade shank 59 is platform 62, which contains a concave side face 63 and a convex side face 64, which is substantially parallel to concave side face 63. Platform 62 also has a leading edge face 65 and a trailing edge face 66, which is substantially parallel to leading edge face 65.

Extending radially outward from and fixed to platform 62 is an airfoil 67 having a leading edge 68, a trailing edge 69. Extending between leading edge 68 and trailing edge 69 is concave surface 70 and convex surface 71, such that they are spaced apart to provide airfoil 67 a thickness. Depending on engine operating conditions, turbine blade 60 may contain a plurality generally radially extending cooling passages in order to cool airfoil 67.

Figure 6:
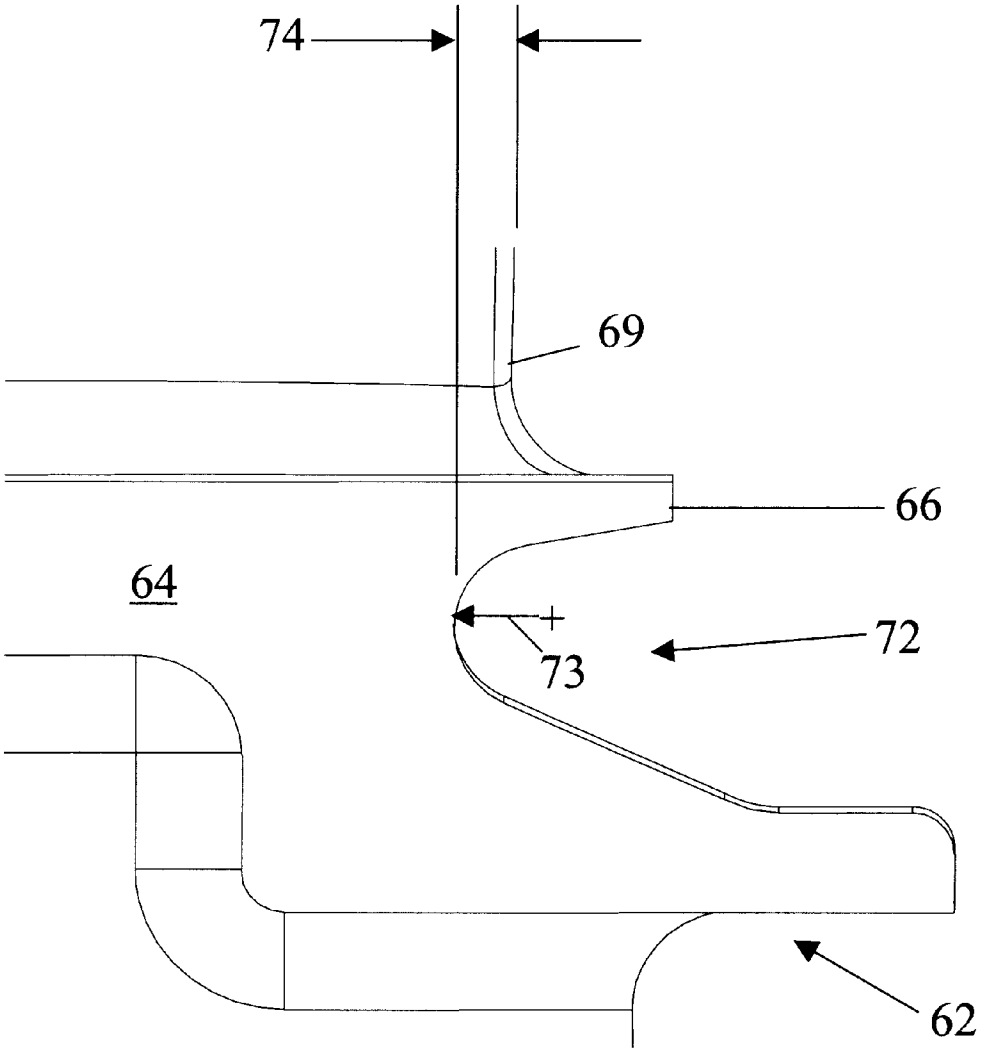
FIG. 6 is a detail side view of a portion of a turbine blade in accordance with the present invention.

Referring back to platform 62, a channel 72 is located in trailing edge face 66 and extends from concave side face 63 to convex side face 64. Channel 72 can be seen in greater detail in FIG. 6. In order to minimize any potential stress concentrations associated with channel 72, it is preferred that channel 72 contain a portion having a constant radius of curvature 73 of at least 0.187 inches, where radius of curvature 73 extends to the deepest point of channel 72 within platform 62. An additional feature of channel 72 is the location of the channel with respect to the load path of airfoil 67 to platform 62. In order to reduce the thermal and vibratory stresses found in the region between platform trailing edge face 66 and airfoil trailing edge 69, it is desirable to alter the platform geometry such that the platform trailing edge region is more responsive to thermal gradients. As shown in FIG. 6, this is accomplished by extending channel 72 and radius of curvature 73 into platform 62 a distance such that they cross into a line of stress created by the turbine blade airfoil load thereby redirecting the mechanical stresses away from the blade trailing edge. Shifting the load away from this region lowers the vibratory stress that can cause potentially damaging cracks. In the preferred embodiment of the present invention channel 72 extends into platform 62 a distance 74 from airfoil trailing edge 69. The preferred distance 74 for channel 72 to extend into platform 62, past airfoil trailing edge 69, is at least 0.050 inches.

An additional enhancement provided by channel 72 extending from concave side face 63 to convex side face 64 is the ability to incorporate channel 72 geometry into the blade casting process, thereby saving manufacturing time and cost associated with machining this detail. By extending channel 72 across the entire trailing edge face of platform 62, a uniform geometry is created in platform trailing edge face 66, which will lead to a reduced chance of defects during the blade casting process. In addition to the manufacturing benefits, removing excess material from the blade platform reduces overall blade weight, which in turn, reduces the pull on attachment 61 when the blade is in operation, since blade pull is a function of blade weight, rotational speed of the set of blades, and radial position of the blade with respect to the engine centerline. Therefore, a slight change in blade weight can have a significant impact on the load experienced by the attachment. A reduction in blade pull lowers the stress level experienced by attachment 61 and increases its operating life.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A gas turbine blade comprising:

a blade shank; a platform directly fixed to said blade shank, said platform having a concave side face, a convex side face, a leading edge face, and a trailing edge face, said concave side face being substantially parallel to said convex side face and said leading edge face being substantially parallel to said trailing edge face;

an airfoil having a leading edge, trailing edge, concave surface, and convex surface fixed to said platform and extending radially outward from said platform;

a channel formed in said trailing edge face of said platform extending from said concave side face to said convex side face, said channel having a portion having a constant radius of curvature and extending into said platform such that said channel crosses into a line of stress created by a blade load.

2. The gas turbine blade of claim 1 wherein said portion of said channel has a constant radius of curvature of at least 0.187 inches.

3. The gas turbine blade of claim 1 wherein said channel is incorporated in said platform during the blade casting process.

4. The gas turbine blade of claim 1 wherein said channel extends into said platform at least 0.050 inches beyond said airfoil trailing edge.

* * * * *